United States Patent [19]

Jefferies

[11] Patent Number: 4,925,328

[45] Date of Patent: May 15, 1990

[54] EXTERNAL RING BINDER

[76] Inventor: Stephen R. Jefferies, 500D Kawaihae St., Honolulu, Hi. 96825

[21] Appl. No.: 227,885

[22] Filed: Aug. 3, 1988

[51] Int. Cl.[5] ..... B42F 13/16

[52] U.S. Cl. ..... 402/77; 281/15.1; 281/42; 402/75; 402/80 R

[58] Field of Search ..... 281/16.1, 17, 21.1, 281/22; 402/22, 46, 26, 29, 31, 42, 73, 74, 75, 76, 77, 78, 80 R, 80 P

[56] References Cited

U.S. PATENT DOCUMENTS

| | | | |
|---|---|---|---|
| 866,845 | 9/1907 | Dawson . | |
| 1,827,592 | 10/1931 | Lewis . | |
| 1,942,564 | 1/1934 | Morehead . | |
| 2,072,471 | 3/1937 | Wolford | 402/75 X |
| 2,091,260 | 8/1937 | Farkas et al. | 283/56 |
| 2,206,317 | 7/1940 | Behn . | |
| 2,268,431 | 12/1941 | Slonneger . | |
| 2,435,521 | 2/1948 | Vernon . | |
| 2,957,477 | 10/1960 | MacLean . | |
| 2,985,173 | 5/1961 | White . | |

FOREIGN PATENT DOCUMENTS

| | | | |
|---|---|---|---|
| 1493017 | 8/1967 | France | 402/80 R |
| 27352 | of 1912 | United Kingdom | 402/42 |

OTHER PUBLICATIONS

English translation of above-referenced patent.

*Primary Examiner*—Paul A. Bell

*Attorney, Agent, or Firm*—Martin E. Hsia

[57] ABSTRACT

A sheet retaining binder is described for detachably holding perforated sheets, the binder comprising a front cover, a rear cover, and a spine, a plurality of sheet retaining rings each ring comprising two portions detachably engaging at one end and hinged at the other; the hinge projecting beyond the sides of the ring and passing through a plate attached solidly to the rear cover such that the hinge axis lies just inside the cover edge and approximately at the middle of the cover thickness dimension. The cover and spine assembly are slotted to allow the rings to pass through. The connections of the covers to the spine and the center-line of the spine are hinged to allow for complete 360 degree rotation of the front cover and any number of contained sheets relative to the rear cover.

11 Claims, 3 Drawing Sheets

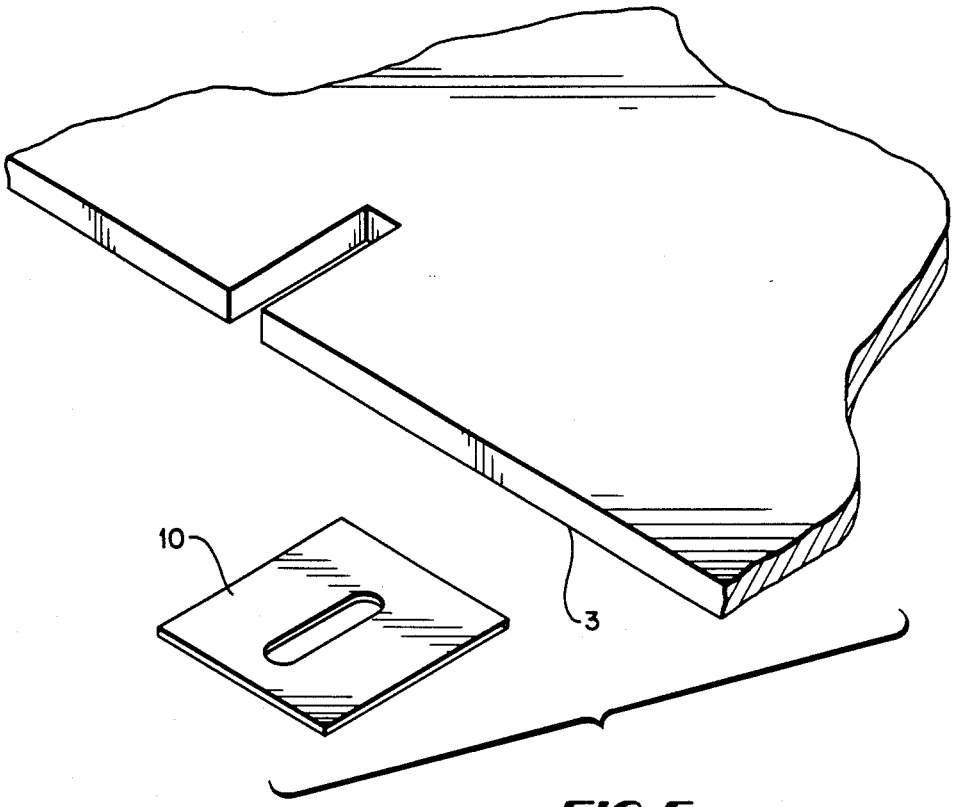
FIG. 5
FIG. 3
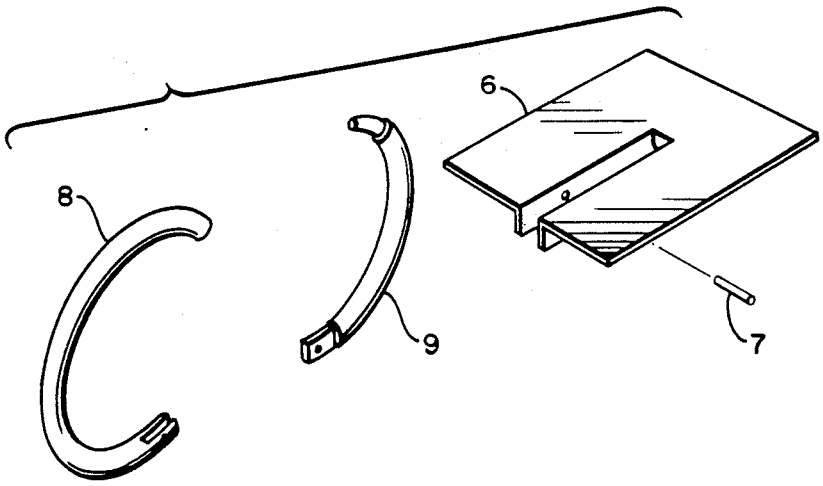

EXTERNAL RING BINDER

BACKGROUND—FIELD OF INVENTION

This invention relates to ring binders, specifically to an improved design incorporating rings which extend outside of the covers.

PRIOR ART

The normal purpose of a binder is to provide a discrete location where sheets of paper can be orderly stored. Such storage media can be generally classified according to the ability of the user to insert new sheets. A simple folder type binder may have no sheet retainer mechanism at all thus allowing the sheets to come and go as they please. At the other extreme are the permanent binders where the pages are permanently attached and no standard means of sheet insertion are possible. (Of course the sheets can always be torn out.) Falling in between these two extremes lies the class of binders allowing for page removal and insertion with relative ease. It is this class of binders which this invention addresses. The vast majority of these use some sort of sheet retainer which passes through some number of holes (usually two or three) punched in one edge of the sheets. This sheet retainer is generally referred to as a ring in the discussion below. The word ring however does not infer any special shape.

The most common form of a ring binder (hereafter referred to as the conventional ring binder) consists of some assemblage of pieces which form three half rings disposed contra-laterally. The ring halves meet in a more or less serrated fashion. A mechanism is provided to allow the rings to spring either apart or together as a single unit due to a relatively small force applied by the user. The cover and spine are normally made of vinyl covered cardboard and the ring mechanism is attached to the spine or back cover with rivets. This type of binder allows for page insertion at any location with considerable ease.

Another common form that could be broadly classified as a ring binder contains the sheets by use of two or more flat metal straps which are inserted through holes in the sheets and bent over flat across the top of the entire stack. In order to insert a sheet the entire stack of sheets prior to the insertion point must be removed from the rings. Insertion of sheets is thus a considerable chore, nonetheless these binders are quite popular due mainly to their low cost, and their considerably reduced size over conventional ring binders.

An additional form of a ring binder is the common spiral type. This type of binder has extreme flexibility compared to the conventional ring binder however it is essentially impossible to insert pages. Nonetheless this binder also is quite popular for some uses due primarily to its low cost, compact size, and extreme flexibility.

The above three ring binder types probably cover 99% of the ring binders currently on the market. There are also some specialty type ring binders such as the Trapper which uses a sliding plastic ring with a male-female mating rather than the more conventional serration. It is also possible to buy separate binder rings which one can insert individually through a stack of papers.

It is worth noting that although the difficulty of page insertion varies drastically over the above mentioned binder types, each has a large market. Thus a binder which combines the compact and flexible features of the spiral binder yet still allows page insertion—even though the page insertion may be more difficult than in the conventional ring binder—could still address a considerable market.

Each of the above binder types has its own set of advantages and disadvantages. The primary disadvantage of the spiral type is that sheets cannot be inserted. Its primary advantages are that is is cheap, compact, and flexible. The flat strip binder on the other hand although allowing page insertion—albeit with some difficulty—does not have smooth sheet movement. This is because each sheet cannot move relative to the ring and the ring remains stationary as the pages are turned. Therefore in order to turn a page the sheet must be folded adjacent to the holes. If it is desired to have the binder lie flat open at a particular page, the entire stack prior to that page must be creased on this fold line.

The conventional ring binder allows by far the greatest ease of page insertion. Its disadvantages include primarily its lack of flexibility, its basic uncompact and unsymmetric form, and its mechanism for retaining the sheets.

Its lack of flexibility is manifested in several undesirable features. For example in order to close one, the user usually must 'help the sheets along' prior to closing the cover or else the sheets close to the top and bottom will end up pinched over. Some of the more expensive models use 'helpers' to somewhat alleviate this problem, however it still exists. Another manifestation of the inflexibility disadvantage is that it is impossible to fold these binders over on themselves at any page (ie., to rotate the front cover 360 degrees such that it lies directly adjacent to the rear cover)—a feature which makes the spiral type particularly appealing. With some of the better quality binders it is possible to do this to some extent but usually only at the first page and even then it is quite a clumsy affair.

Undesirable manifestations due to the uncompactness of the conventional ring binder include the quantity of 'dead' shelf space required due to the fact that the binder dimensions must exceed in thickness the sheet dimensions by at least twice the ring thickness plus the thickness of each cover (and usually considerable more unless the binder is crammed to capacity). In addition a quantity of dead space is require adjacent to the spine approximately equal to the ring diameter. The amount of desk space required is over twice that required by a single sheet due to the inability to fold the front cover all the way around as discussed in the previous paragraph.

By the poor symmetry of the binder is meant its constant triangular shape when viewed from the side. This causes problems for example when attempting to stack binders on top of each other.

The ring mechanism which is the heart of the conventional ring binder is also subject to several disadvantages. The relatively strong spring force involved in the toggle mechanism can cause injury to the fingers when closing the rings. Also the serration used to match the two ring halves tends to become misaligned over time. In addition quite often a gap develops between the two ring halves. This results in a tendency of the mating surfaces to catch the sheets as they are being turned causing sheet damage and sometimes even causing the sheet to slip out from between the rings. If a binder is dropped several feet onto the ground it is often totally ruined because the ring mating surfaces become so misaligned that it is impossible to even forcefully bend them back into sufficient alignment.

It was desired to design a ring binder that allowed for relative ease in sheet insertion yet eliminated most if not all of the above disadvantages.

OBJECTS AND ADVANTAGES

Accordingly the objects and advantages of my invention include the following:

1: to provide a ring binder that is efficient in terms of the total volume of contained sheets compared to the total volume of the binder 2: to provide a ring binder that is efficient in terms of the surface area of a contained sheet divided by the total surface area of the binder when flat open on a desk at any page.

3: to provide a mechanism for closing and opening that does not require a large spring force.

4: to provide a mating of ring halves that does not become misaligned with age and/or mild abuse and where the sheets won't tend to catch on the mating surfaces.

5: to provide a binder where the pages smoothly follow the movement of the front and/or rear covers of the binder.

6: to provide a ring binder where pages can be inserted and or removed at any location with relative ease.

Readers will find further objects and advantages of the invention from a consideration of the ensuing description and the accompanying drawings.

The following figures and description pertain to a working model of the binder which has been built and tested by the inventor. Of necessity many of the items are overly complicated and would almost certainly need to be modified in the final production version for both manufacturing and economical reasons. For example the ring-hinge-pin mechanism could be replaced by a single unit incorporating a 'live' hinge (ie a hinge made of plastic such that deformation of the plastic allows relative movement between the various parts). These are considered to be details of the manufacturing process and won't affect the basic design as discussed in this patent application.

DRAWING FIGURES

FIG. 1 shows a perspective view of the binder according to the invention.

FIG. 2*a* shows a side view of the binder in the closed position. FIG. 2*b* shows a side view of the binder open 180 degrees. FIG. 2*c* shows a side view of the binder open 360 degrees.

FIG. 3 shows an exploded view of the ring-hinge-plate, the two ring portions (loosely referred to as ring halves), and the pin.

FIG. 5 shows an exploded view of one of the front retaining plates and it's position relative to the front cover.

LIST OF REFERENCE NUMERALS

Figure 1:
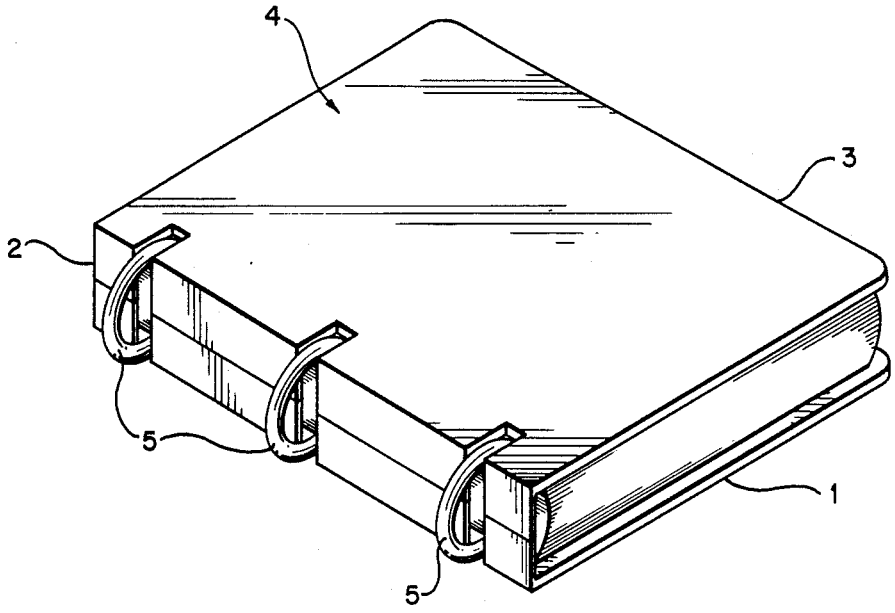

1 . . . Rear cover
2 . . . Spine
3 . . . Front Cover
4 . . . Cover Assembly (items 1, 2 and 3)
5 . . . Ring-hinge-plate assembly
6 . . . Rear hinge plate
7 . . . Pin
8 . . . Female ring half
9 . . . Male ring half
10 . . . Front retaining plate

DESCRIPTION OF INVENTION

FIG. 1 shows a perspective view of the ring binder according to the preferred embodiment. The binder consists of a back cover 1 which is attached to a spine 2 which is attached to a front cover 3. These define the cover assembly 4. The covers and spine are slotted to allow the rings to pass through. The connections of each of these items as well as the centerline of the spine are hinged. This hinge can consist of nothing more than the vinyl covering overlaying the cardboard covers and spine. (This is exactly the manner in which conventional ring binders are connected to their spines.)

FIG. 3 is an exploded view of a single ring-hinge-plate mechanism 5. (In the preferred embodiment there are three such mechanisms). The hinge-plate 6 is attached solidly to the rear cover 1 and drilled to accept the pin 7. Each ring half 8 and 9 is also drilled to accept the pin. Each ring half is thus free to independently rotate about the pin axis.

FIG. 5 shows a perspective view of the front retaining plate 10 and it's attachment location to the front cover 3. In the preferred embodiment there are three such retaining plates.

OPERATION OF INVENTION

Figure 2A:
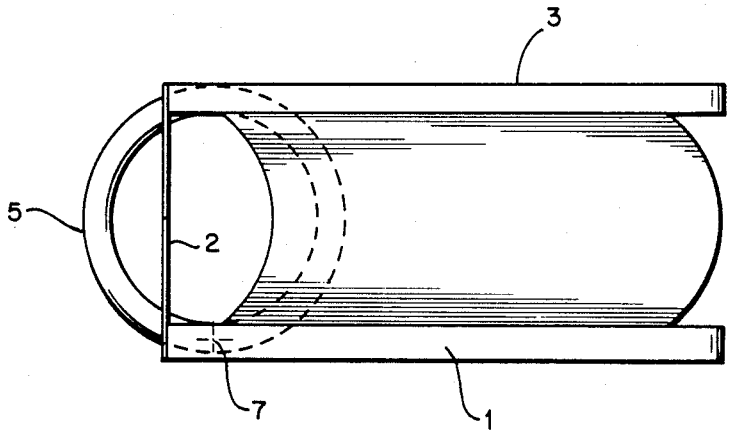

FIG. 2 shows the binder in three common positions. When closed (FIG. 2*a*) the front and rear covers are parallel and all the sheets are contained therein. Due to the design of the front retaining plate, the pin location, and the thickness of the covers the rings do not protrude past the outer plane of each cover when the binder is filled to capacity and is in the closed position.

Figure 2B:
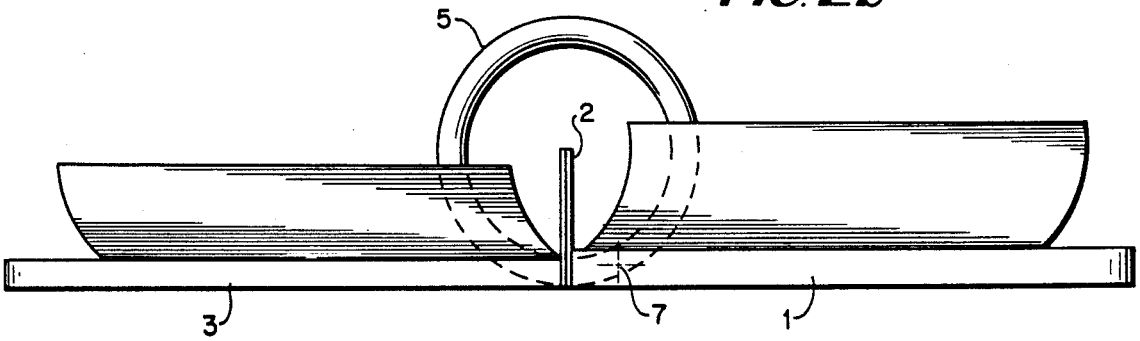

In order to open the binder the user lifts the front cover at the right edge along with as many sheets as he desires. As the cover is lifted the spine bends inwards (toward the pages) and the ring pivots on the hinge plate as much as necessary. When the front cover has been rotated 180 degrees the configuration will be as shown in FIG. 2*b*. The oblong slot in the front retaining plate allows more smoothness to this process.

Figure 2C:
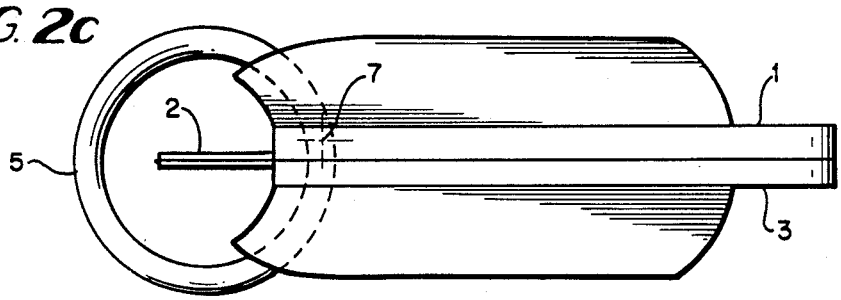
Figure 4:
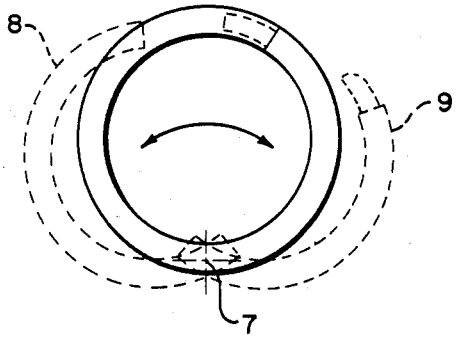
FIG. 4 shows a side view of a single assembled ring in the closed and open position.

If the user desires he may continue to rotate the front cover an additional 180 degrees until all the items assume the positions shown in FIG. 2*c*. The ring pair continues to pivot about it's pivot point as far as is required. This depends upon the number of pages adjacent to each cover.

The binder is so flexible that it can be closed by rotating either the front cover, the back cover, or both. The pages follow the cover movement with no tendency to catch or pinch because the rings are free to rotate relative to the cover.

INSERTING/REMOVING SHEETS

In order to remove sheets the user activates each latch mechanism separately and opens each ring. This can be done in either the 180 degree open or the 360 degree open position (or indeed in any position in between). The latch mechanism can be any of a number of designs. The preferred embodiment uses a positive type latch such that the user has to press a small 'button' located on the top of each ring at the same time as forcing the rings apart by hand. (This could be activated with the tip of a pencil or pen.)

The prototype does not use a positive latch. In fact the only latching mechanism used is a kinematic one due to the difference in arc length of the two ring halves. This causes a snapping action as they are shut. Some force is required to separate them. Although this action may be adequate, it is believed that a positive latch would be necessary for increased security against accidental opening.

In either case the ring halves will be closed by merely pressing the two halves together for example with thumb and forefinger.

CONCLUSION AND SCOPE OF INVENTION

Thus the reader will see that the ring binder of the invention provides a compact, flexible device which still allows relative ease of page insertion.

While my above description contains many specificities, these should not be construed as limitations on the scope of the invention, but rather as an exemplification of one preferred embodiment thereof. Many other variations are possible. For example as mentioned previously the ring-hinge-plate mechanism could be replaced by a single part unit with a live hinge. It may also be possible to eliminate the front retaining plate by including it as part of the front cover. Accordingly, the scope of the invention should be determined not by the embodiments illustrated, but by the appended claims and their legal equivalents.

I claim:

1. A binder for storing sheets of paper, comprising:

a substantially flat rear cover;

a plurality of sheet retainers, each comprising two portions;

pivoting means for connecting said sheet retainers adjacent to an edge of said rear cover whereby said sheet retainers pivot about a sheet retainer pivoting axis parallel to said edge;

latching means for selectively engaging and disengaging said portions of said sheet retainers, whereby said sheets of paper can be inserted and removed;

a spine having a front cover edge and a rear cover edge, rotatably attached to said rear cover edge to said rear cover, wherein said spine comprises a first plate and a second plate foldably attached to each other along a spine folding line, whereby said first plate and said second plate can be folded in relation to each other; and a substantially flat front cover having apertures corresponding to said sheet retainers rotatably attached to said front cover edge of said spine.

2. A binder according to claim 1, wherein:

said spine folding line is parallel to said sheet retainer pivoting axis.

3. A binder according to claim 1, wherein:

said latching means comprises a male member extending from said first portion of said sheet retainer and a corresponding female aperture in said second portion of said sheet retainer.

4. A binder according to claim 1, wherein said sheet retainers comprise rings.

5. A binder according to claim 1, wherein said covers are approximately rectangular in shape.

6. A binder according to claim 1, wherein said rear cover includes apertures corresponding to said sheet retainers.

7. A binder according to claim 1, wherein said spine includes apertures corresponding to said sheet retainers.

8. A binder according to claim 1, wherein said pivoting means comprises:

a hinge plate having a pin aperture attached to said edge of said rear cover; and a pin passing through a sheet retainer and into said pin aperture.

9. A binder according to claim 1, wherein said sheet retainer pivoting axis passes through said rear cover and is spaced a predetermined distance from said edge.

10. A binder according to claim 9, wherein said predetermined distance is between approximately one inch and one-sixteenth inch.

11. A binder according to claim 10, wherein said predetermined distance is approximately one-eighth inch.

* * * * *